US005218899A

United States Patent [19]

Jacobs

[11] Patent Number: 5,218,899

[45] Date of Patent: Jun. 15, 1993

[54] HIGH EFFICIENCY CENTRIFUGAL DECORTICATOR OF OIL GRAINS

[76] Inventor: Wilson E. Jacobs, Rioja 2761, (1636) Olivos - Province of Buenos Aires, Argentina

[21] Appl. No.: 753,229

[22] Filed: Aug. 30, 1991

[30] Foreign Application Priority Data

Sep. 18, 1990 [AR] Argentina ..... 317894
May 5, 1991 [AR] Argentina ..... 319868

[51] Int. Cl.[5] ..... B02B 3/00; B02B 7/02

[52] U.S. Cl. ..... 99/609; 99/519; 99/524; 99/617; 99/622

[58] Field of Search ..... 99/518-520, 99/524, 574-576, 600, 601, 609-615, 617-622; 426/483, 482; 241/7, 260.1, 261.1

[56] References Cited

U.S. PATENT DOCUMENTS

| | | | |
|---|---|---|---|
| 2,405,561 | 8/1946 | Egedal | 99/622 |
| 2,651,470 | 9/1953 | Dodds et al. | 99/617 |
| 3,626,478 | 12/1971 | Lawton | 99/576 |
| 3,703,200 | 11/1972 | Palyi et al. | 99/617 |
| 4,196,224 | 4/1980 | Falk | 426/483 |
| 4,313,374 | 2/1982 | Tjerrild | 99/622 |
| 4,317,411 | 3/1982 | Forrest et al. | 99/574 |
| 4,341,152 | 7/1982 | Solenthaler | 99/519 |
| 4,393,762 | 7/1983 | Jacobs | 426/482 |
| 4,583,455 | 4/1986 | Salete-Garces | 99/523 |
| 4,978,078 | 12/1990 | Vadnay | 241/260.1 |

FOREIGN PATENT DOCUMENTS

| | | | |
|---|---|---|---|
| 1292826 | 2/1987 | U.S.S.R. | 99/617 |

*Primary Examiner*—Timothy F. Simone
*Attorney, Agent, or Firm*—Marks & Murase

[57] ABSTRACT

A grain decorticating machine is provided with a distributor rotor and an impact band. The impact band further includes impact surfaces shaped in the form of an annular succession of first plates oblique with respect to the radius of the rotor, and by an annular surface, coaxial with the rotor and situated behind the annular succession of first plates. The annular surface faces the outer radius of the rotor. An opening is defined between each pair of adjacent first plates. The openings thus formed provide tunnels for passage of the air blown from the rotor and also for the decorticated materials. The rotor has a roof and a floor which define an annular crown. The annular crown is subdivided internally by a plurality of radial partitions, with each adjacent pair of radial partitions defining a radial crown segment which faces outward toward the impact band. Each of the radial segments has at least one internal plate that defines at least one radial channel, the channel's height being smaller than the minimum height of a grain as measured with the joining edges of the Hull shells in a vertical position, and larger than the height of the grain measured when the joining edges are disposed horizontally.

11 Claims, 4 Drawing Sheets (DRY PULP IS PROPORTIONAL TO TONNAGE OF GRAINS MILLED)

HIGH EFFICIENCY CENTRIFUGAL DECORTICATOR OF OIL GRAINS

BACKGROUND OF THE INVENTION

The purpose of the present invention is to increase the efficiency of centrifugal decorticators capable of ejecting a stream of grains to collide against an impact surface.

Specifically, the present invention covers improvements in machinery capable of prying open the hulls of grains to which sufficient kinetic energy has been transmitted for impact against a conveniently positioned surface.

To more specifically clarify the purpose of the present invention, mention shall be made of what is meant by "Grain" throughout this description. Grain is a vegetable body comprising a soft central part identified as Kernel, enclosed by a hard covering, usually identified as Hull.

In this description, mention shall be made of the problems appearing in the Sunflower (Helianthus annuus) oil milling industry. Nevertheless, it should be understood that the present invention could be applied to the decortication of other oil grains, such as Safflower, Soya, etc.

Decortication is the action of separating the Hulls from the Kernels, prior to milling and extracting the Oil from the Kernels.

In particular, the present invention is directed to but is in no way limited to the decortication of Sunflower grains, or other grains.

Sunflower grains have an approximate average weight of 0.07 grams; of this weight, approximately 70% corresponds to the Kernel.

In the oil grain industry, particularly in Sunflower oil milling, two high value commercial products are obtained:

The Oil, extracted from the Kernel, and

The solid part of the Kernel, after extraction of the Oil, which constitutes an excellent component of balanced feeds. (This solid part is usually called Meal in the milling industry.)

The Oil and the Meal are obtained from the Kernel, whereas the Hulls show negative qualities, not only from a nutritional standpoint, but also because of their detrimental influence as regards the milling capacity of an oil factory.

In particular, Hulls occupy great volumes of the oil producing machinery, reducing the amount of Kernels which can be milled and the production of Oil (Meal is considered a by-product). The presence of Hulls is the limiting factor in the production capacity of a given oil mill.

Obviously, the ideal solution would be to achieve a total elimination of the Hulls; the product to be milled would then be entirely composed of Kernels.

Sunflower grains have previously been milled with inefficient decorticating systems, or even by direct extraction, with no decortication of the grains.

When milling with this last mentioned method, efficiency is very low; also, the quality of the extracted Oil and of the Meal are particularly inferior.

Also known are equipment that, by means of a particularly violent mechanical action, do crack the Hulls, but simultaneously break the Kernels; so, from this known machinery there emerges a mixture of Kernels and Hulls of diverse granulometry. Also, this known equipment, by the violent mechanical action, causes bits and pieces of Kernel to remain adhered to the separated Hulls. The Hulls—with adhered Kernel fractions—are usually burnt as fuel (or sold at a very small price for other general uses). The Oil and Meal contained in the fractions of adhered Kernels, thus constitute a total loss.

It is interesting to note that a Sunflower decorticator processing 100 metric tons/24 hours (a normal capacity) must attend to one million grains per minute. In a way, these conditions explain the inherent difficulty in achieving the ideal circumstance of totally de-hulling the grains and further separating pure Kernels from totally clean Hulls.

Presently, because of the above-mentioned circumstances, oil mills generally content themselves with milling Kernels in a mix with some 14–19% Hulls.

The above circumstances imply, among other disadvantages, a deterioration of the quality, both of the Oil and the Meal. Hulls include a small percentage of wax which, in the milling process, melts and is incorporated into the Oil. This wax must be later eliminated, as it clouds the Oil, impairing its value. A process for unclouding the Oil is denominated "winterization".

The quality of the Meal is damaged mostly by the Hull presence. Protein percentage decreases drastically (Hulls contain only about 2% protein, which unfavorably averages out with the very high protein content of the solid part of the Kernels); also, Hulls contain about 60% Fiber, making the Meal inadequate for, among others, chicken balanced diets. Hulls also contain Lignine, a definite antidigestion substance.

Naturally, the above-mentioned quality-damaging characteristics of Hull presence increases in proportion to the weight of the Oil shedded along the extraction process. For example, a 15% Hull presence in the Kernels to be milled can well increase to a 26% presence in the Meal, due to the loss of the weight of the Oil.

The above-described impossibility of obtaining a clear Oil and a Meal of a good enough quality to make a reasonable profit has induced a number of mills to adopt the so called "integral" milling method, abandoning inefficient decorticating as not worth their while. Such "integral" milling—commercial reasons apart—causes a tremendous drop in the quality of the products, especially the Meal. In these cases, Kernels enter the milling process mixed with at least 25–30% Hulls; the corresponding Meal will have over 40% Hulls. The consequence of the above is that a very high percentage of Fiber and also of Lignine (and the resulting very low Protein) transform a first class foodstuff into an extremely low grade feed.

Once the grain has been decorticated, the mixture of Kernels with the least possible percentage of Hulls is passed through presses which extract a high percentage of the Oil; the material emerging from the presses (known as Cake) contains about 15% Oil. This Cake then proceeds to solvent (hexane) extractors from which the Meal emerges, which is then commercialized including about 1.5% Oil and 12% humidity.

As described previously, it is evident that a smaller percentage of Hulls—entering the presses mixed with the Kernels (ideally 0%)—would bring about the following most important advantages:

A purer Oil, with less wax content.

A Meal having a high Protein content and a low Fiber and Lignine content, with excellent nutritive value.

An enlargement of the milling capacity for a given oil factory due to the elimination of Hulls (low specific weight-high specific volume) and their replacement by Kernels (high specific weight-low specific volume). Such an increase in milling capacity is achieved with no alteration in production costs; it is a true saving.

A previous excellent design is a Decorticating machine corresponding to the Argentine Patent No. 201397, of the same inventor, which Patent is incorporated together with the present description as added documentation, to better clarify the scope of the present invention.

This known Decorticating machine allows a range of some 14–19% Hulls accompanying Kernels in the mix going to presses and extractor. This design complies with accepted international standards. It consists of a grain distributor placed over a spinning rotor with radial blades disposed around a nucleus which orientates discharge, the rotor is surrounded by an annular Impact Band, which faces the rotor's discharge. Between the Impact Band and the rotor's discharge, there is defined an annular opening for discharge of the decorticated material, which decorticated material enters a Hull separator, generally pneumatic; this Hull separator does not fall within the scope of the present invention.

Grains are ejected from the rotor, by centrifugal action, and against the mentioned impact band; the grains are broken by the resulting concussions. This Decorticator corresponding to Patent No. 201397, as well as the other decorticators known in the art, do not solve the problem of the grains adopting diverse positions within the rotor and, consequently, hitting the impact band at diverse positions and angles.

In analyzing oil grains—especially Sunflower grains—it is observed they present a flattened shape; their Hulls are defined by two shell-shaped and substantially symmetrical parts, joined at the edges and their material is composed of cellulosic fibers, joined by lignine. Their physical build-up makes them particularly resistant and resilient such that they strongly oppose the decorticating action.

Nevertheless, it is known that, if it is possible to achieve an impact of said grains at high speed against a solid surface, and the impact happens against one of the hull-joining edges (with the grain so positioned that both joining edges are on a plane perpendicular to the impact band), then the two shells of the Hull will separate along the joining edges, as along these joining edges are where the least resistant parts of the Hull are located.

Further, in the decorticator of the present invention, one of the joining edges of the Hulls (the one opposite the impacting edge) is abraded against the hardened steel of the rotor channels, which weakens the joint and facilitates decorticating, as will be later explained.

Consequently, if a high energy lateral impact is achieved along one of these lines of fracture, the two Hull shells shall open, freeing the Kernel from inside and, through this decorticating action, making possible the later separation of Kernels from Hulls.

SUMMARY OF THE INVENTION

The object of the present invention is a Decorticating machine capable of flinging the grains in a guided flight, with the grains maintaining a horizontal position; that is, with one of the hull shells on top of and the other shell under the flying grain, so as to achieve an impact against an impact band along one of the lateral joining edges of the Hull's shells. Grains are flung from the rotor in succession, one after the other, defining an ordered stream of grains.

It is also a purpose of the invention that the rotor cause the distribution of grains in streams at different levels of different heights—all of them within the range of the impact band—in a way that the grains are distributed between the different levels. This decreases the very high rate of wear of the impact band which would occur if all of the grains were to collide at the same height. An added advantage of the aforementioned division in levels, is the larger separation resulting between the grains that fly towards impact, driven also by the intense airflow, which separation decreases the probability of interference between grains.

It is also a purpose of the present invention, to achieve a non-air-retaining impact band through which air can freely flow and thus consequently avoid the accumulation within the impact band of soft decorticated material which could cause a damping effect, and thus cushion the impact of the grains. In the below-described way, the strong airflow sweeps the decorticated materials away immediately after impact; the impact band is left free to receive the next-in-line grain.

From the standpoint of operative results, it is an object of the present invention to obtain a Decorticating machine capable of breaking the bond between Hulls and Kernels in a way that the so-loosened Hulls may then be separated from the industrially valuable Kernels by means of a separating machine (preferably pneumatic). The ultimate goal being the attainment of a mix of valuable Kernels with a maximum of 4% to 7% Hulls (either loose or still attached) included.

Such a low presence of Hulls in the mixture with the Kernels implies many important advantages in the milling of oil grains, especially Sunflower grains: wax is drastically reduced in the Oil; in the Meal, there occurs a much higher presence of Protein and correspondingly lower percentages of Fiber and Lignine. All of these conditions contribute to greatly improved nutritive qualities.

A further and no less important industrial advantage derived from milling with the aforementioned low Hull contents is the dramatically increased milling capacity of a given mill (with practically no corresponding increase in operating costs). This is a consequence of substituting valuable Kernels (of high specific weight, low volume) for the eliminated Hulls (low specific weight, high volume).

Based on the aforementioned combination, many are the embodiments that can be achieved but, tending to make clear the advantages until now briefly explained, to which users may add many others, and also to make more clear the constructive details and the functions of the impact bands and the rotors associated to said impact bands, in a grain decorticating machine, according to the present invention, following there is described a preferred example of the embodiment, which is also illustrated in the enclosed Figures. It is also made clear that, in the understanding that the aforementioned description is just an example, said example should not be considered as limiting the range of protection of the present invention patent: rather, it should be made clear that the above description is simply informative and illustrative in character, to make more clear the basic conception of the present invention.

Note: In the aforementioned Figures, same references indicate same components and parts illustrated.

DESCRIPTION OF THE PREFERRED EMBODIMENTS

Figure 1:
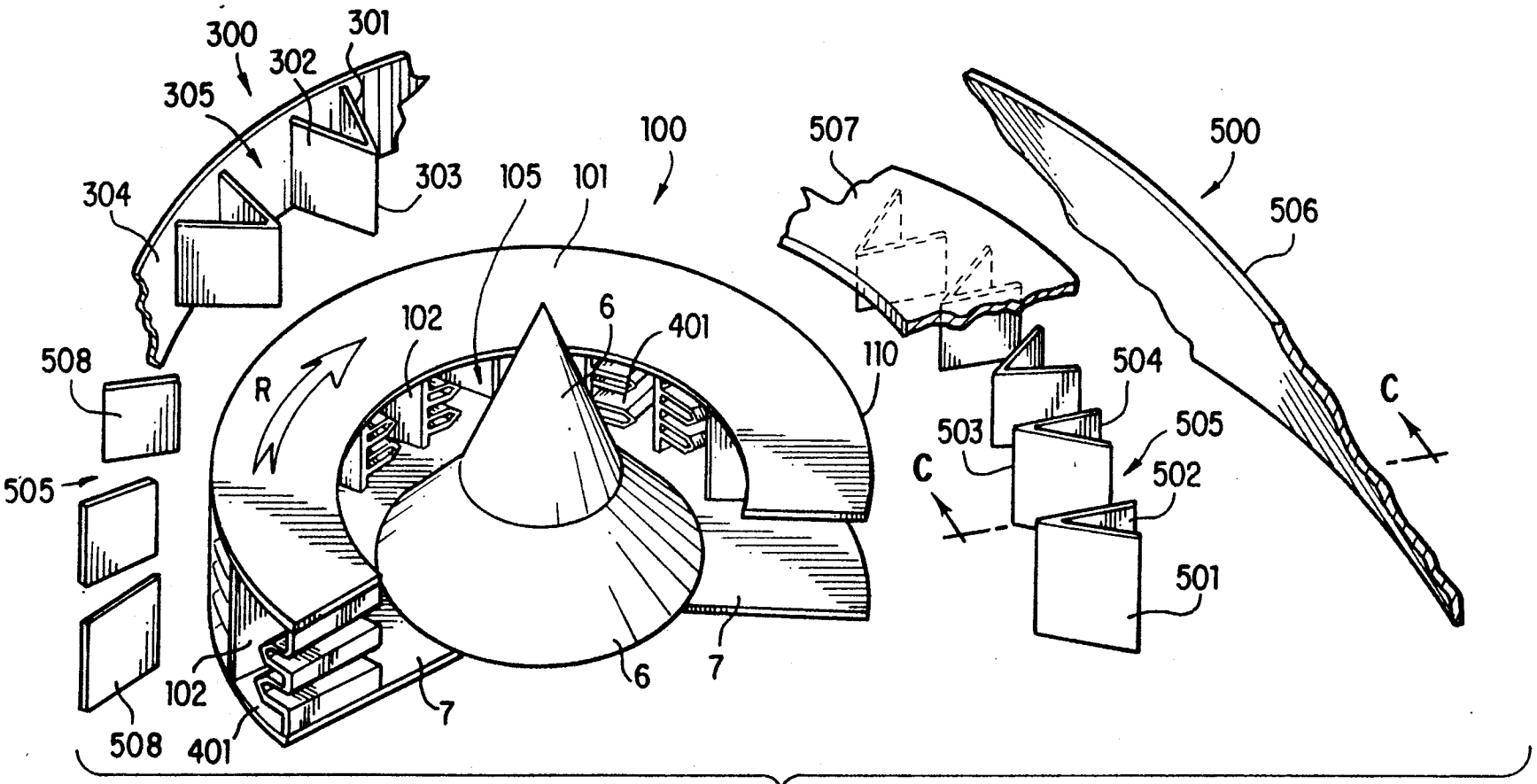
FIG. 1 shows, in a partial and sectioned perspective, the components which are fundamental to the present invention in its various embodiments and in their relative positions. Not shown are all other components necessary for the functioning of this machine, but which are not a part of the present invention.
Figure 2:
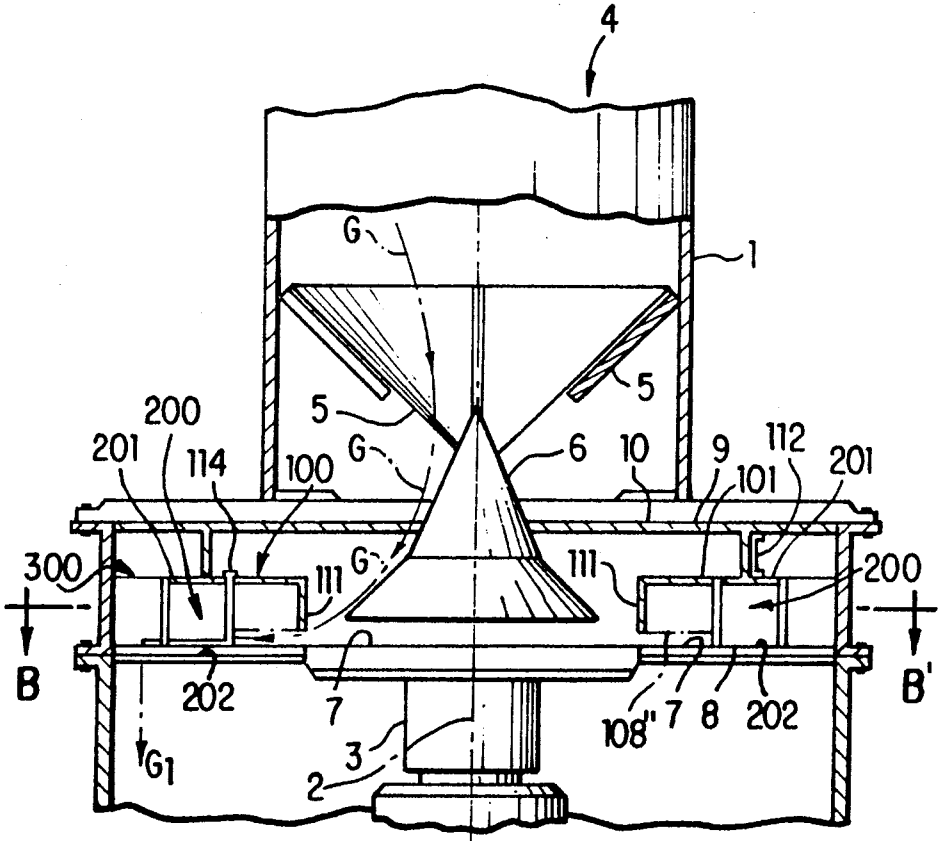
FIG. 2 shows section AA' according to FIG. 3. It corresponds to one of the embodiments appearing in FIG. 1, but completed with its functional components.

To start with the analysis, we will refer to FIGS. 1 and 2, in which reference numeral (1) indicates the outer casing of a grain feeder. This outer casing (1) is generally circular, and its central axis (2) coincides with that of the axle (3) which supports and spins the rotor (100). Axle (3), in turn, is actuated by a generic motor means (not illustrated), causing the rotation of axle (3) and of the rotor (100) of the decorticating machine.

Casing (1) has an inlet opening (4) through which enter the whole grains (G) (to be decorticated) and air. Following inlet (4) is a grain distributor (5) and later a cone (6), which guide and conduct grains (G) towards the entrance to the rotor (100), as will be later explained. The entrance and subsequent course of the grains is indicated by a dotted line identified by the letter (G), in FIGS. 2 and 3. Finally, axle (3) is joined to a platform (7) which supports the rotor (100). All the previously described is well known and used in the Art, for which reason it is deemed unnecessary to enlarge its description.

The present invention is characterized by consisting of a particular rotor (100) which, in some versions, is followed by a statoric volume (200), and later by the impact bands (300) or (500), according to the versions or specific embodiments considered.

Figure 3:
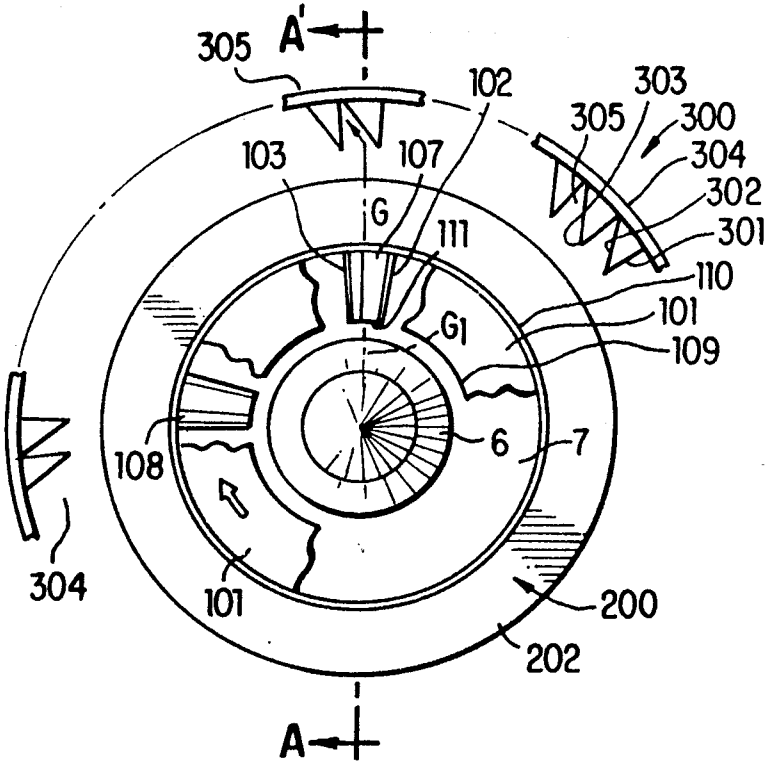
FIG. 3 shows, in a partial and schematic form, Section BB' of FIG. 2.

Analyzing rotor (100) in particular, with the aid of FIGS. 1, 2 and 3, it is observed that it rests on the platform (7), which consists of a lower disc surface that spins freely with respect to cone (6), and below it.

Said disc surface (7) is continuous; above it, is placed an upper disc crown (101), parallel to the platform (7) and at a predetermined height over the same. Separation between floor (7) and roof (101) of the rotor (100) is determined by means of a plurality of radial partitions (102) substantially equal to each other, and which partitions (102) obviously reach from said floor to said roof (101). In some of the embodiments of the present invention, some radial partitions (103) are not vertically connected from the floor (7) to the roof (101) of the rotor (101), but always—between each pair of radial partitions (103)—there is formed a space in the shape of a radial segment of a circular crown (105). (See FIGS. 1, 4, 5, 6 and 7.) Within each of said radial crown segments (105) there exists at least one plate that defines the channels (108) that make possible the ejection of the grains in a determined position and in an ordered succession.

The organization of said channels (108) varies in accordance with the embodiment considered.

In FIGS. 2, 6, 7 and 8 can be observed a first embodiment, in which case—within the radial crown segment (105)—partitions (102) define first radial partitions, substantially equal one to another; and partitions (103) define second radial partitions substantially equal to one another and separated from partitions (102); and so constituting a succession of partitions (102), (103). Second partitions (103) are joined only to floor (7) and are short in height, having a free side surface, or edge (104). Within the radial segment (105) there is placed a separating plate which consists of a first length of separating plate (106)—parallel to the floor (7) and to the roof (101) and which continues in a second length of separating plate (107) that, starting from first plate length (106) forms an oblique ascending surface; these second lengths (107) may either be flat ascending surfaces or curved ascending surfaces.

The first length (106) of the aforementioned separating plate starts from the second partition (103) and rests on its free edge (104); this first length (106) is separated from the floor (7) by a distance substantially similar to the height of the grain when in a reclining position—as will later be explained—whereas the length of this plate (106) is substantially similar to the width of the grain when in a reclining position.

Between the surface portions of floor (7) and those surface portions corresponding to first and second separating plate lengths (106), (107) that face them, there is defined a radial channel (108), formed by the opposite faces of first partition (102), second length (107) and floor (7), which defines an oblique walled channel (108'), and the opposing faces of second partition (103) plate (106) and floor (7), which defines a quadrangular and constant section channel (108'). The channel (108) is open at both ends in the rotor, that is, at the internal perimetrical edge (109) and the external perimetrical edge (110). The portions of the internal edge (109) and also of the external edge (110) which do not define channels (108) may be closed by a plate or similar covering (111).

In another of the possible embodiments of the present invention—illustrated in FIGS. 1, 4, 5 and 9—each radial segment (105) is sub-divided by means of plates (401) into a plurality of horizontal channels (402). Said plates (401) may be substantially horizontal plates or, instead, may be replaced by a curved plate or a mechanized block.

It is important to note that said plates (401) are joined to partition (103), in the direction of the rotating motion origin, and end before reaching the opposite partition (102), so defining a free space.

In the embodiment in which this space (105) is divided in a plurality of channels, it is preferable to subdivide the space (105) into several horizontal channels (402), allowing the division of the ordered streams of grains (G) into several levels, and so lessening wear in the impact bands (300, 500) and also allowing a greater separation between the flying grains; this last condition decreases the probability of interference between impacting grains.

Another alternative of the invention, not obligatory in character, consists in placing—outwards from the external perimeter edge (110) of the rotor (100)—a statorical volume (200) consisting of a pair of circular crowns or plates (201, 202), parallel and distanced from each other, and so placed that the upper circular crown (201) is basically at the same level as lower circular crown (101), while the lower circular crown (202) is basically at a level with rotor floor (7). This tends to guarantee that the air and grains streams emerging from the rotor impinge against the impact band without distortions of any kind.

It is essential that said statorical volume (200) be free of any kind of contact with moving parts of the machine; for such reason its upper circular crown (201) is suspended from the roof of the equipment by means of a simple suspension device (112); the lower circular crown (202) is supported in a conventional manner.

According to the present invention, the rotor outlets face the impact band, generically indicated under references (300) or (500), depending on type of embodiment.

Firstly, analyzing the embodiment represented by FIGS. 2, 3, 6, 7 and 8, it can be noticed that impact band (300) is made up of a plurality of plates (301, 302) arranged in pairs. In one of the embodiments considered, one plate (301) of each pair is radial with respect to the turning center of rotor (100) whilst the other plate (302) of the same pair, is obliquely disposed with respect to the first plate, in such a way that both plates intercept and form an edge (303), which edge faces the mentioned statorical volume (200).

These pairs of plates (301, 302) are disposed either next to each other or separated by regular intervals, along a virtual circumference; they are joined to support means belonging to the device's construction, such as the cylindrical band (304).

Conveniently, this cylindrical band (304) can be a part of the outside wall of the decorticating machine; also, the previously mentioned plates (111) may be placed in the inside and outside edges of the rotor, so closing any aperture that could alter the flow of air and/or grains.

Also, a band (113) can be added, which tends to prevent re-circulation of air expelled by the rotor action. The sense of the rotor's turning is indicated by the notation "R".

The cylindrical band (304) has a surface coaxial to the rotor axis that forms a part of the impact band (300).

Between each pair of plates (301, 302) there is the open space (305) which ends against said cylindrical band (304); together they determine the evacuation outlet through which the decorticated grains (opened or cracked) fall to the bottom exit of the decorticating machine.

The aforementioned plates (301, 302) are not necessarily one radial and the other oblique; both can be oblique with respect to the rotor radius, and joined at the common edge (303).

Another of the possible construction alternatives for said impact bands is illustrated in FIG. 1, with references in the (500)'s series. In FIG. 1, it can be observed that the impact band (500) is made up of first plates (501) and second plates (502), annularly grouped in pairs around the rotor axis and facing the rotor at a determined distance; each pair of plates (501, 502) determines a vertical attack edge (503) that paces the rotor (100), in the same manner as forementioned edge (303); following, the plates (501, 502) are disposed with at least one plate oblique with respect to the radius of the rotor (100), while the back edges (504) are divergent. The biggest difference between this embodiment and the preceding one is defined by the following details: between each pair of back edges (504) is defined an evacuation tunnel (505); also, behind and separated from said edges (504) there is placed an annular surface (506) that completes the impact band (500). Said annular surface (506) may be either conical in shape, as illustrated in FIG. 1 or cylindrical; also, the annular surface (506) may be removable or constitute a part of the machine's casing. These mentioned impact bands (500) can all be joined to a roof plate (507) and may or may not have another inferior plate extending to edges (503), and are obviously designed to leave clear the evaluation tunnel (505).

The impact bands (500) may also include an annular series of singular plates (not in pairs) as, for example, the series of plates (508), which may be planar or curved, oblique with respect to the radius of the rotor, and separated one from the other, so determining passage (505) between each pair of plates (508).

Another version—not illustrated—contemplates the possibility that the plates, in any of the versions, may have altered their angles with respect to the rotor radius by means of regulating mechanisms obviously already known.

Following and with the aid of the included Figures, there shall be described the functioning of the present invention and the advantages accruing from its use.

Rotor (100) presents its radial crown segments (105) in the form of partitions—eventually detachable. These partitions, which in one of the versions presented, form channels (108) and in the other version form channels (402), constitute channels of a substantially constant cross section that extends from the internal perimetrical edge (109) of the rotor (100) to the external perimetrical edge (110).

A fundamental characteristic of the invention consists of the entrance to tunnels (108) being circumferentially placed along the edge of the central orifice (109), basically in coincidence with inlet (10) existing in the roof (9) of the rotor's chamber through which inlet (10) penetrate air and the grains to be decorticated. Each channel (108,402) is directly in contact with the floor of the rotor (7).

Any space permitting free access of air to the rotor and not being an inlet to one of the channels (108,402) must be covered by means—as an example—of plates (111) or (113). (This last means to avoid re-circulated air.) It is fundamental to avoid entrance of grains or air to the rotor, except through the channels (108, 402) mentioned.

From the standpoint of the dynamics of the airflow, the aforementioned channels (108, 402) act as the blades of a high pressure ventilator. So, being radially placed, when turning they induce a high air depression in their internal perimeter which, in its turn, creates a strong inductive air current entering the machine through inlet (4) and which, passing through casing (1) enters the various channels (108, 402). During the described action, the air carries the grains (G) with it at high speed.

It is convenient that the air current maintain its course with no deflections and basically parallel to the axis of the tunnels.

For such reasons, in one of the illustrated versions (see FIGS. 2, 3 and 8), it is possible to create a statoric volume (200) by means that enclose the current of air emerging from the rotor such as, in this example, plates (114).

The trajectory of the grains within the decorticating machine, in accordance with the present invention, is identified by a dashed line designated with the notation (G). On the left side of FIG. 2 can be seen how the grains (G), proceeding from distributor (5), enter the rotor (100) and, after passing through the rotor (100), collide on the impact band (300, 500) and later fall along the evacuation tunnel (305, 505) towards the bottom discharge opening of the decorticating machine.

In FIGS. 4, 5, 6, 7 and 9, it is shown how the grains (G) arrange themselves: Notation ($G_1$) shows a grain entering the rotor; ($G_4$) shows a grain about to leave rotor; ($G_5$) shows a grain as impacting on impact plate (501) of impact band (500). Notation ($G_6$) illustrates the grains already impacted, which re-impact on the annular plate (506). ($G_7$); indicates the already decorticated grains, falling along the evacuation tunnel (505).

Figure 7:
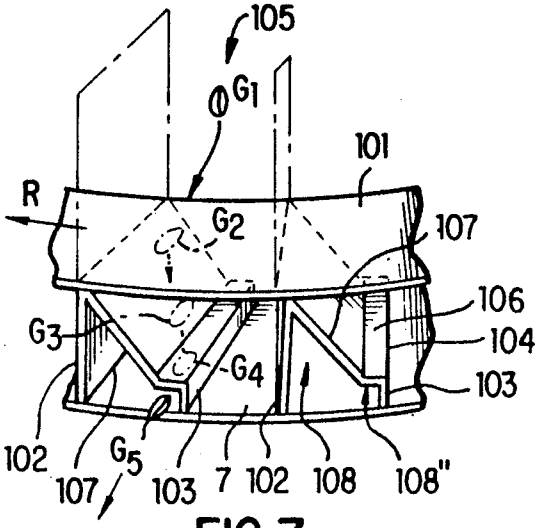
FIG. 7 shows the same embodiment as in FIG. 6, but in this case in perspective.
Figure 6:
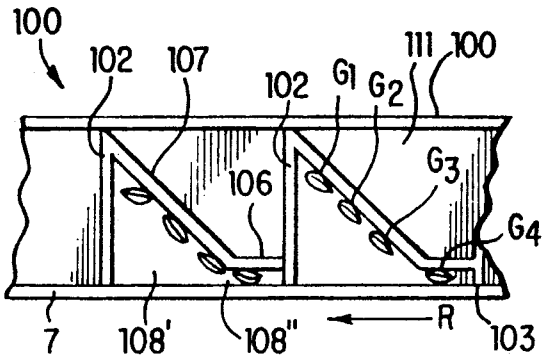
FIG. 6 is similar to FIG. 5, but showing another version of tunnels, arrangement.
Figure 8:
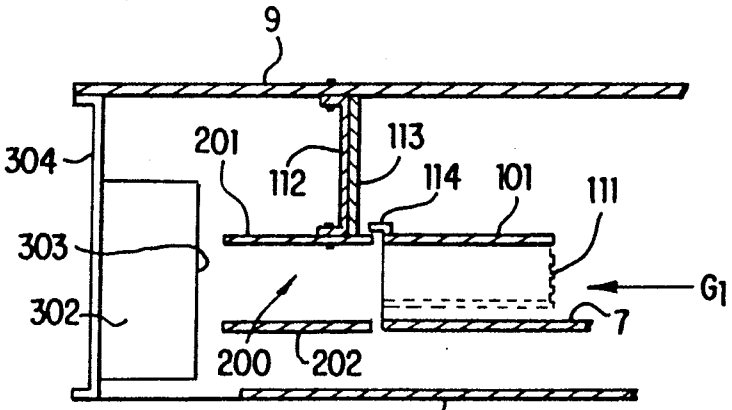
FIG. 8 shows an enlarged detail of Section AA, according to FIG. 3.

To analyze, for example, the processes illustrated in FIGS. 6 and 7, which show one of the possible shapes of the aforementioned channels, it can be observed how the grains find their positions within said tunnels. So, grains ($G_1$) enter each tunnel carried by the strong air current induced in that position; immediately on entering they adopt position ($G_2$) leaning on inclined plate (107). Such plate, by effect of centrifugal force, displace the grains downwards ($G_3$) finally reaching position ($G_4$) in which position the joining edges of the hull shells remain parallel to the acceleration vector; in other words, with the Hull joining edges are perpendicular to the impact plates (302, 502, 508) according to the embodiment considered. In one embodiment, it can be seen that channel (108) allows only one ordered spray of grains (one after another) per radial channel. This disposition shows advantages, but also the inconvenience that grains ($G_5$) emerging at high speed in an ordered succession, are all at the same level of impact, and may accumulate on the impact plate (304, 506) and cause a "cushion" effect, attenuating the impact (and the de-hulling) of following grains. Also, with all impacts in one level only, the wear of the impact plates (302, 502, 508) could become excessive, demanding frequent replacements.

Figure 4:
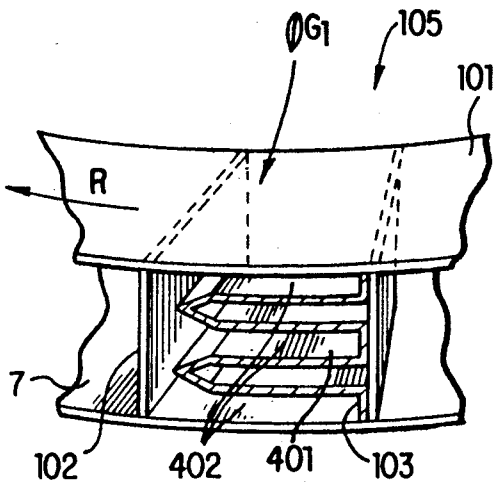
FIG. 4 shows, in a detailed perspective, one of the crown segments with its radial tunnels, according to one version of the invention.
Figure 5:
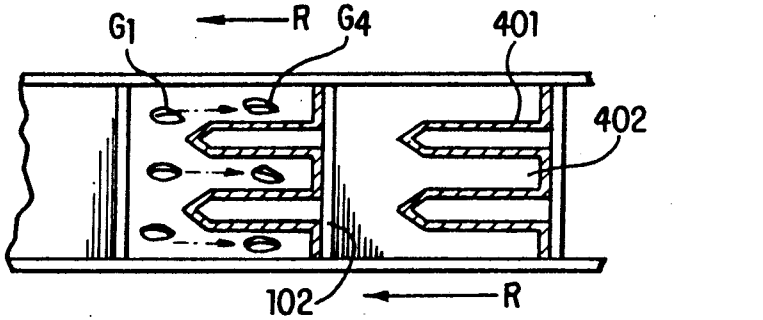
FIG. 5 is a front view of two of the crown segments appearing in FIG. 4.
Figure 9:
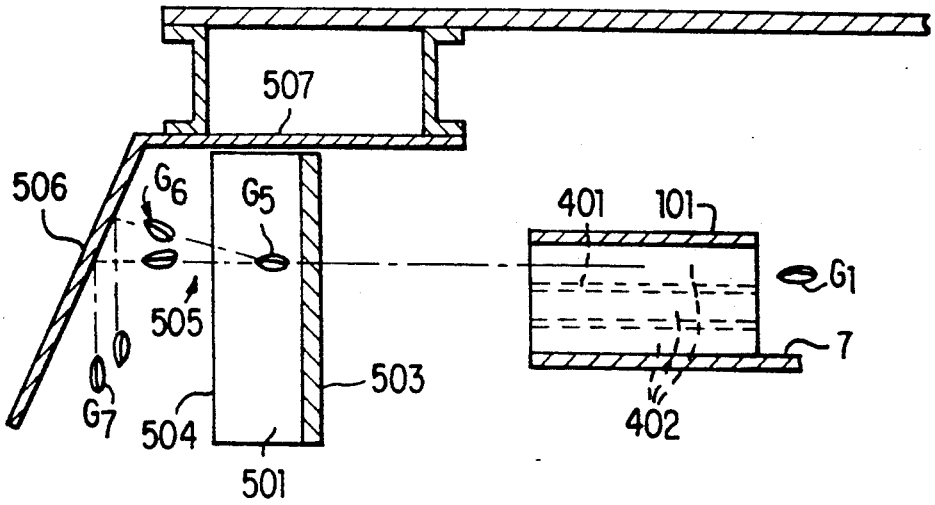
FIG. 9 shows Section CC' from FIG. 1, illustrating one of the possible embodiments of the invention, different from that appearing in FIG. 8.
Figure 10:
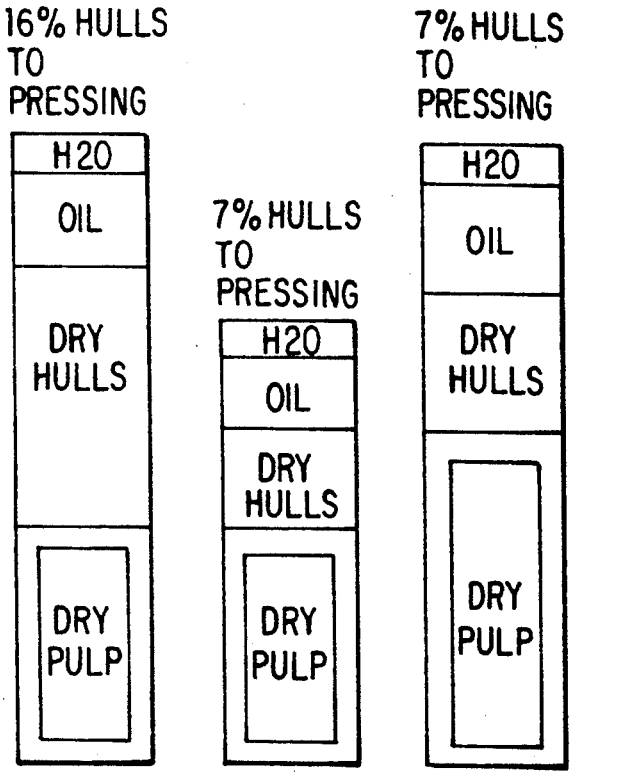
In FIG. 10 there appears, in a graphic form, the increase in the milling capacity of a given oil factory, in a comparison when milling with 16% and 7% of Hulls mixed with the Kernels, respective.

The above-mentioned circumstances are avoidable by adoption of the embodiments shown in FIGS. 4 and 5, in which there appear defined several channels (402) per radial segment. This arrangement allows for the distribution of the rotor's ejected grains (G) at different levels. Several advantages are obtained: there is less (or no) cushioning effect; and wear of the impact plates (302, 502, 508) is reduced in proportion to the number of channels per radial rotor tunnel.

From the previous descriptions, it emerges that one of the principal functional advantages of the present invention is to provide that the grains impact against the impact band (304, 506) laterally, that is, sidewise, with the Hull joining edges in a horizontal plane. This causes an instant shocking impact on one of the mentioned joinings or fracture edges. These conditions facilitate separation of the Hull shells; the decorticating action is caused mainly by the pressure action of the Kernel from the inside and also that of any air held between the shells, which actions tend to separate the shells. It should be added that the aforementioned decorticating action is aided by a previous action pertaining to the present invention: while the grains travel outwards along the radial channels in the rotor tunnels, their joining edges in contact with the hardened steel of the bottoms of the channels are partially abraded by the strong friction induced by centrifugal force; therefore this joint is weakened. As this weakened joint is opposite to the joint that impacts on the impact band, the opening of the shells by the inside pressure is made more easy, and the probability of decortication increases significantly.

The lateral impact—with the joining edges in a horizontal position—implies a further and important advantage, which is that the Hulls (later separated by pneumatic action) appear clean, with no adhered Kernel particles. This does not happen in other existing decorticating machines where grains impact longitudinally or sideways. In these last cases, broken bits of Kernels frequently adhere to the separated Hulls and so constitute a financial loss since separated Hulls are usually burned as fuel or sold for other uses at insignificant prices. Hulls separated after decorticating according to the principles of the present invention, appear white and clean; nearly all the valuable Kernel material is sent to milling and generates profit.

It follows from the above, that the position and organization of the impact plates should be such as to make possible the impacting of the grains with their joining edges in a horizontal position and, further, ideally arriving in succession and not colliding one with the other. These conditions are achieved with the present invention, because each grain emerges from its rotor channel at a differential of time and a differential of radian, relative to the following grain.

The following is an example that shows the advantages obtained by milling Sunflower grains according to the present invention, in comparison with results obtained with known decorticating equipment.

Sunflower grains contain a Kernel which is one of the best (if not the best) of the oil-grain kernels from the viewpoint of the nutritive quality of its components.

A normal composition of a Sunflower Kernel would be:

| | |
|---|---|
| Oil | 60% |
| $H_2O$ | 5-6% |
| Dry pulp | 34-35% |
| | 100% |

Sunflower Oil stands out as being one of the best in the market.

The solid part of the Kernel (Dry Pulp) is also, from a nutritional standpoint, a first class material, because it not only offers percentages of Protein approaching 57-58%, but such Protein also contains seven essential Amino acids. In other words, the Protein is a first class nutritive material, even for humans.

But this excellent Kernel material is surrounded by a Hull (made up of two shells joined at the edges) which: 1) is extremely difficult to remove, and 2) contains some 60% of hard Fibre joined by Lignine, both of which materials are damaging to nutrition. Hulls also have small amounts of wax which, when incorporated into the Oil, must be removed before commercialization. Hulls constitute an average of 30% by weight Sunflower grains.

The object of Sunflower milling is to obtain: a) an excellent Oil, pure and refined, and b) a Meal, which consists of the Dry Pulp, with a small percentage of Oil as a remnant of the extraction process and also a regulated amount of humidity.

All the above shows that it is most convenient—even mandatory—to eliminate from the process as much of the Hulls as possible (indeed all of it, if possible). Following shall be described succinctly the situation at present in the Sunflower Oil milling industry.

In an attempt to eliminate Hulls from the milling process, some factories use decorticating machines known in the Art, which machines generally employ systems which cause the grains to impact against hardened surfaces. In general, these methods achieve the impacts in indeterminate positions of the grains, with the effect that the emerging decorticated material is made up of an infinite variety of shapes and sizes, of both Kernels and Hulls. From such a mixture, the multi-sized and multi-shaped Kernels and Hulls must be separated from one another and respectively cleaned, the pure Kernels to be milled and the pure Hulls generally to be burnt as fuel.

Note: Matters are not made easier by the fact that a decorticator processing 100 tons of grain each 24 hours (a normal occurrence) must attend to about 900,000 Sunflower grains per minute.

Reality is very different from the desired action described. Due to the infinite variety of shapes, sizes and weights of the billions of pieces obtained, the separated Kernels are accompanied by diverse percentages of Hulls; also, the Hulls carry along diverse amounts of Kernel bits, which constitute a direct loss, as hulls are generally burned in the boiler furnace, as mentioned previously.

The above-mentioned circumstances have resulted generally in the existence, today, of two kinds of Sunflower Oil mills: 1) those which decorticate the grain and mill a product composed of an average 15–16% of Hulls in a mix with the Kernels (thus producing Oil with a high amount of wax, and Meal with high Fiber and low Protein), and 2) those which have simply resignedly abandoned decorticating and feed the whole grains (with some 30% Hulls) directly to a solvent extractor (thus, obtaining an Oil with extreme contents of wax, and Meals with similarly extreme percentages of Fiber and Lignine, and very low Protein). Obviously, both final products (Oil and Meal) are of very low quality. The Oil, after complicated refining and "winterizing" (to eliminate wax) is made usable. The Meal can only be incorporated in small quantities in balanced feeds, but is not usable for monogastrics (chickens, pigs, etc.). All of the above naturally reduces the economic possibilities of such mills.

All of the aforementioned clearly shows how the presence of Hulls (and its included Fiber and Lignine) deteriorate the quality of the Oil and more still that of the Sunflower Meal.

These negative effects by themselves should be enough to spur research concerning a way to diminish the Hull presence. But there is another very important reason that points the same way: all oil grain mills use a solvent extractor as a final operation in the separation of the valuable Oil, in many cases preceded by presses that initiate the process. When these machines are fed with a mixture of valuable Kernels and inert Hulls, an important circumstance arises:

1) Hulls present a very low specific weight and as a consequence, they take up great volumes; Kernels show a much higher specific weight and occupy much less unit space.

2) Further compounding the above circumstances, as soon as the material enters the machinery (presses or extractor), Kernels start shedding their oil and their volume decreases accordingly.

The above described facts indicate a very great added advantage resulting from the elimination of Hulls from the process: an important increase of the milling capacity of a given mill without an appreciable increase in the costs of operation. In effect, when large volumes of an inert and damaging material (that of Hulls) are replaced by greater weights of valuable Kernels, an obvious increase in capacity and a simultaneous attainment of greatly improved products results.

Note: As regards production capacity of an oil mill, the "bottleneck" is the solvent extractor, which will take up to a certain volume of material, without causing an undue increase in the residual fat (oil) appearing in the Meal (accepted values around 1–1.5%). This comment reveals—with still more emphasis—the convenience of eliminating the mentioned large volumes of Hulls.

The present invention makes possible the milling of Sunflower grains with a maximum of 7% Hulls in the mixture with the Kernels.

To quantify the above reasoning, in the following pages appear three Tables showing the factors intervening in the process. They refer to oil mills which decorticate the Sunflower grains, one mill obtaining a mix with 16% Hulls, the other only 7%.

Both mills pass the material through presses (which extract part of the Oil) and, in both cases, from the presses there emerges a material (called Cake in the industry) which contains 15% Oil and 6.5% $H_2O$. This Cake is what enters the solvent extractors and its volume (relative to the tonnage of grains being milled) is what limits the production capacity.

The following Tables were calculated on the basis of an actual laboratory analysis corresponding to normal production grains. Humidity in the Hulls entering the process was taken at 8%, a normal value.

TABLE 1

| Hulls in Kernels | Dry Pulp | | Dry Hulls | | Oil: 15% | | $H_2O$: 6.5% | | Cake | |
|---|---|---|---|---|---|---|---|---|---|---|
| % | Wt. | Vol. | Wt. | Vol | Wt. | Vol | Wt. | Vol. | Wt. | Vol |
| 16 | 33.91 | 26.08 | 17.52 | 29.2 | 9.83 | 10.92 | 4.26 | 4.26 | 65.52 | 70.46 |
| 7 | " | " | 6.92 | 11.53 | 7.80 | 8.67 | 3.38 | 3.38 | 52.01 | 49.66 |

TABLE 2

| Hulls in Kernels | Dry Pulp | | Dry Hulls | | Oil: 15% | | $H_2O$: 6.5% | | Meal | |
|---|---|---|---|---|---|---|---|---|---|---|
| % | Wt. | Vol. | Wt. | Vol | Wt. | Vol | Wt. | Vol. | Wt. | Vol |
| 16 | 33.91 | 26.08 | 17.52 | 29.2 | 0.89 | 0.99 | 7.13 | 7.13 | 59.46 | 63.40 |
| 7 | " | " | 6.92 | 11.53 | 0.71 | 0.79 | 5.66 | 5.66 | 47.20 | 44.06 |

Tables 1 and 2 show the different figures (in Weight and Volume), corresponding to two stages of the oil-milling process. The material milled in this study consists of one hundred parts of Kernels to which have been added Hulls (with an initial 8% humidity) to constitute two mixes: one with 16% Hulls, the other with 7%. These materials we have passed, first, through presses where they shed part of the Oil and emerge as what is called Cake in the industry. The percentages of Oil and $H_2O$ adopted are the normal values in these machines. The significance of Table 1 is to allow us to compare the Volumes of the Cakes when allowing 16 or 7% Hulls in the mix. This is of primary importance, for the Cake now proceeds to the solvent extractor and, as previously discussed, capacity of the extractor is limited by volume. The ratio of the volume 70.46/49.66=1.42 shows the increase capacity coefficient resulting from the decrease in Hull presence.

Table 2 shows the figures corresponding to the material that emerges (called Meal in the industry). To these must here be added the figures corresponding to Protein and Fiber content which are fundamental to the Meal's value, as it is mostly commercialized as a component in balanced feeds. The Meal corresponding to a 16% mixture of Hulls in the mix with Kernels shows a Protein content of 34.66%. With a Hull presence reduced to 7%, Protein content ascends to 43.01%. As for Fiber content, the percentages are 22.70% for the 16% Hull mix; 15.20% for the 7% Hull presence.

Table 3 below, quantifies the action in an oil mill which is milling at its maximum capacity of 1.000 tons of grain per 24 hours and which has a Hull content of 16% in its milling material.

The mill is able to immediately reduce its Hull presence to 7%, with no change whatsoever in her presses or extraction equipment.

In the aforementioned situation, capacity would increase, as would also the quality of products, in accordance with the data in Table 3 below.

TABLE 3

| Hulls in Kernels % | Grain tons. per 24 hrs. | Meal tons | Oil. tons | Protein % | Fiber % |
|---|---|---|---|---|---|
| 16 | 1,000 | 445.9 | 443.3 | 34.66 | 22.70 |
| 7 | 1.419 | 468.9 | 629.5 | 43.01 | 15.20 |

The aforementioned data correspond to a mill that decorticates the grain, and later presses the decorticated material and finally extracts the remaining Oil in a solvent extractor.

For those mills which do not decorticate or press, and which pass the whole grains integrally through a solvent extractor, the advantages derived from eliminating the Hulls, both in quantity and quality of products, and especially so if presses are added, are considerably larger.

Having so described and illustrated the nature and principal object of the present invention—and also the means by which said invention can be materialized—it is claimed as of exclusive property and for the term accorded by the Law:

1. An oil grain decorticating machine of high efficiency and centrifugal action for decorticating grains having hulls which include two symmetrical shells attached along a joining edge, the decorticating machine comprising an impact band and a rotor capable of distributing and ejecting the grains fed to the machine against the impact band, the impact band further comprising an annular succession of first impact plates coaxial with respect to the rotor and oblique with respect to the rotor radius, an annular surface coaxial with respect to the rotor and placed beyond the annular succession of first impact plates, and an annular succession of openings coaxial with respect to the rotor and defined between the bases of adjacent pairs of the first impact plates for evacuation of air blown through the rotor and decorticated material, the rotor further comprising an annular crown having inner and outer radii and having a roof and a floor, the annular crown being internally sub-divided by a plurality of radial partitions, each pair of the plurality adjacent radial partitions defining therebetween a radial segment of the annular crown, each of the radial segments having at least one separating plate that defines at least one radial channel extending between the inner and outer radii of the annular crown, at least a portion of the channel having a region of constant minimum height which is less than the minimum height of a grain with its joining edge in a vertical plane and larger than the maximum height of the grain with its joining edge in a horizontal plane.

2. The oil grain decorticating machine as claimed in claim 1, wherein the first impact plates are radially separated from one another.

3. The oil grain decorticating machine as claimed in claim 1, wherein the impact band further comprises an annular succession of second plates, oblique with respect to the radius of the rotor, said first and second plates being joined in pairs along a vertical edge substantially parallel to the rotor's axis and defined by the convergence of each pair of first and second plates to form an annular succession wedges facing the outer radius of the annular crown of the rotor.

4. The oil grain decorticating machine as claimed in claim 1, wherein the impact band further comprises an annular succession of second plates parallel to the radius of the rotor axis, said first and second plates being joined in pairs along a vertical joining edge substantially parallel to the rotor's axis and defined by the convergence of each pair of first and second plates to form an annular succession of wedges facing the outer radius of the annular crown of the rotor.

5. The oil grain decorticating machine as claimed in either claim 1 or claim 4, wherein the annular surface is joined to the outermost radial edges of the plates.

6. The oil grain decorticating machine as claimed in claim 5, wherein the annular surface comprises a cylindrical surface which is part of the decorticating machine's outer casing.

7. The oil grain decorticating machine as claimed in claim 1, wherein said annular surface is provided in a form of a truncated cone with its larger diameter below and spaced from the outermost edges of the annular succession of plates.

8. The oil grain decorticating machine as claimed in claim 1, wherein the separating plate that defines at least one radial channel has a portion that is oblique with respect to the floor and roof of the annular crown and a portion which is perpendicular to the floor and roof of the annular crown, forming a channel having a maximum height at the portion of the channel most downstream from the rotor's sense of rotation which converges to said minimum height at the region upstream of the rotor's sense of rotation.

9. The oil grain decorticating machine as claimed in claim 1, wherein the separating plate that defines at least one radial channel is folded upon itself in a way to define several channels which are vertically stacked in the axial direction of the rotor, said channels having a maximum height at the region of the channel most downstream with respect to the rotor's sense of rotation and converging to said minimum height at the region upstream of the rotor's sense of rotation.

10. The oil grain decorticating machine as claimed in claim 1, wherein each of the radial segments have a plurality of separating plates that define a plurality of radial channels disposed each above the next with respect to the axis of the rotor, said channels having a maximum height at the region of the channel most downstream with respect to the rotor's sense of rotation and converging to said minimum height at the region upstream of the rotor's sense of rotation.

11. The oil grain decorticating machine as claimed in claim 1, further comprising a statoric volume disposed between the rotor and the impact band, said statoric volume preventing dispersion of air flow.

* * * * *